US007825817B2

(12) United States Patent
Bray et al.

(10) Patent No.: US 7,825,817 B2
(45) Date of Patent: Nov. 2, 2010

(54) HARDWIRED ALARM SYSTEM WITH POWER-ON SEQUENCE

(75) Inventors: William J. Bray, Minneapolis, MN (US); Adrienne G. Thomle, Plymouth, MN (US); Donald L. Harju, Brooklyn Park, MN (US); Mark B. Panzer, Plymouth, MN (US); Robert G. Schermeister, Champlin, MN (US)

(73) Assignee: Honeywell International Inc., Morristown, NJ (US)

( * ) Notice: Subject to any disclaimer, the term of this patent is extended or adjusted under 35 U.S.C. 154(b) by 475 days.

(21) Appl. No.: 11/425,945

(22) Filed: Jun. 22, 2006

(65) Prior Publication Data

US 2007/0296569 A1 Dec. 27, 2007

(51) Int. Cl.
*G08B 17/10* (2006.01)

(52) U.S. Cl. ..... 340/632; 340/514; 340/516; 324/511; 702/58

(58) Field of Classification Search ..... 340/506, 340/511, 514, 516, 632, 538, 538.17, 628–634; 702/50, 185
See application file for complete search history.

(56) References Cited

U.S. PATENT DOCUMENTS 4,345,242 A * 8/1982 Ienna-Balistreri ..... 340/634
4,860,223 A * 8/1989 Grilk ..... 702/19
5,265,032 A * 11/1993 Patel ..... 702/188
5,432,500 A * 7/1995 Scripps ..... 340/628
5,459,450 A * 10/1995 Beghelli ..... 340/538
5,598,139 A * 1/1997 Karim et al. ..... 340/286.11
5,729,197 A * 3/1998 Cash ..... 340/539.3
5,886,638 A * 3/1999 Tanguay ..... 340/632
5,896,091 A * 4/1999 Soderlund ..... 340/686.4
6,114,950 A * 9/2000 Schaible et al. ..... 340/435
6,456,471 B1 * 9/2002 Haun et al. ..... 361/42
6,873,256 B2 * 3/2005 Lemelson et al. ..... 340/539.1
6,919,809 B2 * 7/2005 Blunn et al. ..... 340/632
6,948,352 B2 * 9/2005 Rabbett et al. ..... 73/1.04
7,336,191 B2 * 2/2008 Drews et al. ..... 340/632
7,515,058 B2 * 4/2009 Normand ..... 340/632
2006/0076896 A1 * 4/2006 Osborn et al. ..... 315/86
2006/0290525 A1 * 12/2006 Andersen et al. ..... 340/632

OTHER PUBLICATIONS

Chart, "CO2 Monitoring System, Ensuring a Safe Working Environment," 2 pages, prior to Jun. 22, 2006.

(Continued)

*Primary Examiner*—Davetta W Goins
*Assistant Examiner*—Anne V Lai
(74) *Attorney, Agent, or Firm*—Crompton Seager & Tufte LLC

(57) ABSTRACT

A sensor and alarm system having a power-on sequence. The system has a power supply permanently-like connected to a power line of a facility. There may be a power interrupt to the power supply, which may initiate a power-on sequence of alarms. The sequence of alarms may indicate whether the system is wired properly and operating normally. If the sequence does not occur in a pattern as expected, then there may be a problem with the system. Also, the sensor portion of the system may set off an alarm pattern if a sensed gas has a concentration greater than a first magnitude. The system may set off another alarm pattern if a sensed gas has a concentration greater than a second magnitude. If a sensing element of the sensor portion goes out of calibration, then the system may set off still another alarm pattern.

22 Claims, 5 Drawing Sheets

OTHER PUBLICATIONS http://www.chartindustries.com/app, "Chart Innovation, Experience, Performance, CO2 Monitoring Systems," 3 pages, prior to Jun. 22, 2006.

Infineon Technologies, "CoolSET-F2, Off-Line SMPS Current Mode Controller with Integrated 650V/800V," 1 page, Jan. 2004.

McDonald's, "CO2 Safety Systems," 2 pages, prior to Jun. 22, 2006.

* cited by examiner

HARDWIRED ALARM SYSTEM WITH POWER-ON SEQUENCE

BACKGROUND

The present invention pertains to alarms and particularly to alarms connected to room air sensors. More particularly, the invention pertains to alarms with an operational test sequence.

SUMMARY

The invention is an air sensor alarm system having a power interrupt and a power-on sequence for verifying satisfactory operation.

DESCRIPTION

Figure 1:
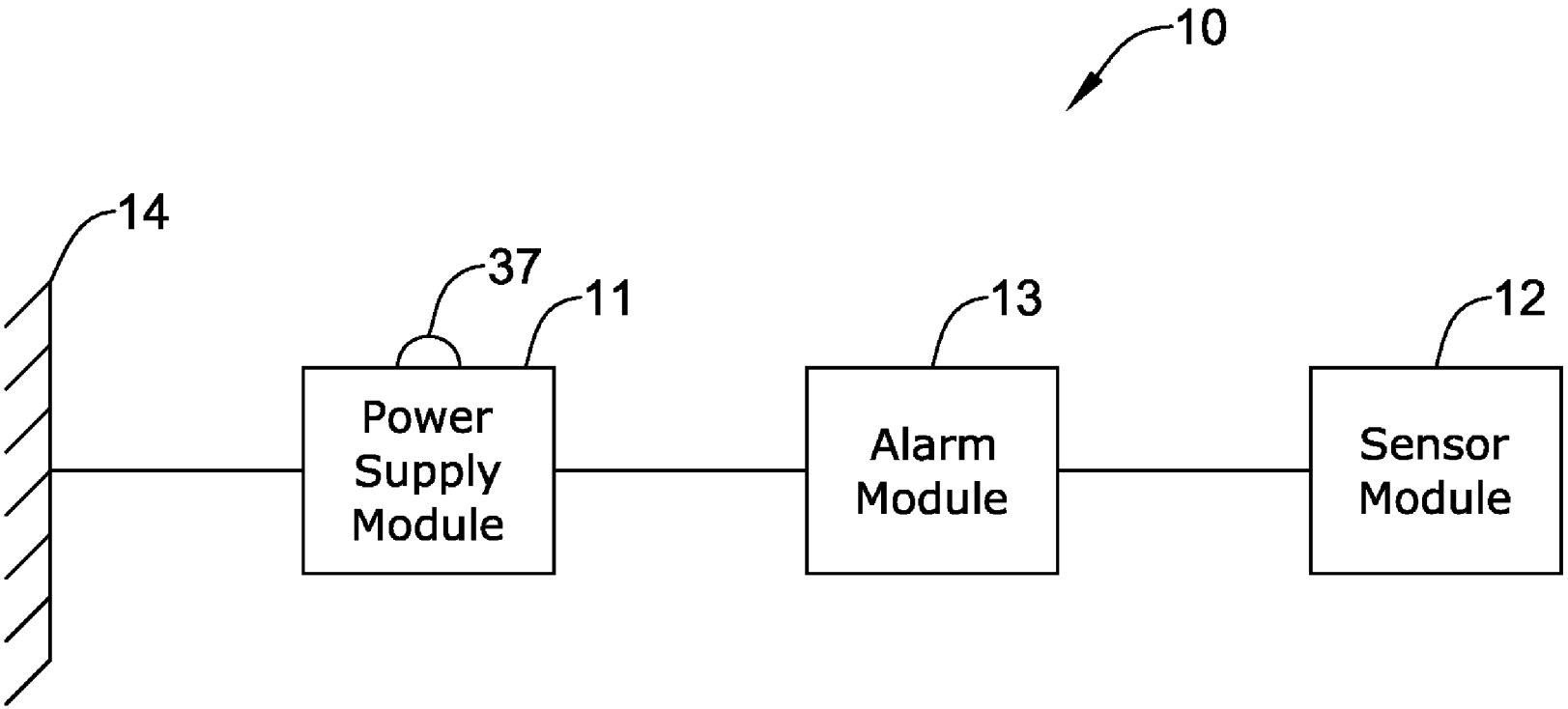
FIG. 1 is a block diagram of an alarm equipped gas sensor.

FIG. 1 shows a block diagram of a sensor system 10. A power supply 11 may be connected permanently to power of a structure (e.g., building) 14 where the system is situated. A permanent power connection for system 10 may require installation of an appropriate junction box. System 10 may be designed to be non-pluggable in an outlet and have no non-permanent electrical power connection easy to disconnect. Power may be provided from supply 11 to a sensor 12 and an alarm 13. The wire connections may be made at or in the alarm or alarm module 13. System 10 may have a combination of more than one sensor 12 and/or more than one alarm 13.

Figure 2:
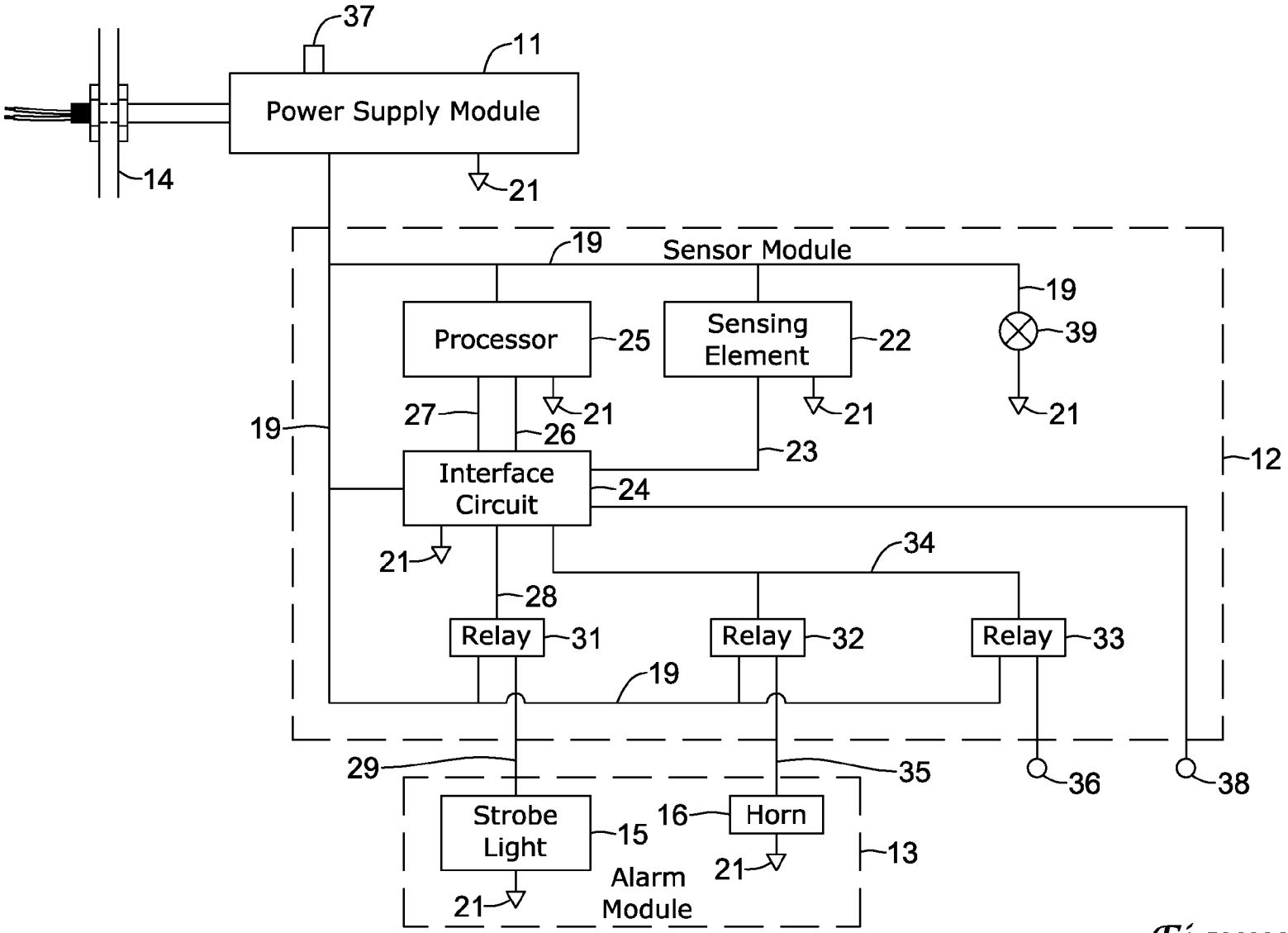
FIG. 2 is a diagram of an illustrative example of the alarm system shown in FIG. 1.

FIG. 2 shows an illustrative example of the gas alarm system 10 having the power supply 11, the sensor 12, and a strobe light 15 and a horn 16 for the alarm 13. The strobe light 15 may provide about 30 or more flashes of white light per minute. The brightness and strobe rate of light alarm 15 may be adjusted. The alarm 16 may emit a sound of about 75 dB. The loudness or intensity and type of sound from alarm 16 may be adjusted. The sound may be electronically synthesized. The visual and audio alarms may be other kinds of indications besides those illustratively shown as examples.

For security against tampering, the power supply or power supply module 11 may be permanently and/or hardwired to live power of the building or structure 14. The sensor or sensor module 12 may be for sensing $CO_2$ or another gas. Alarms may include other kinds of devices such as annunciators, telephone calls, alert communications, and the like. System 10 may be used as a stand-alone system or be tied in with a building automation system.

An illustrative example of the invention may be described herein to show the elements of the system 10. The example system 10 described herein uses certain kinds of components for illustrative purposes; however, some of these components may be replaced with other kinds but equivalent types of components. The present example system 10 may be a $CO_2$ alarm system in a space that alerts occupants of high levels of $CO_2$ or another gas which may be hazardous to their health. Places where the alarm system 10 may be used include carbonated beverage dispensing areas, manufacturing plants, chemical laboratories, supermarkets, and so on.

The power supply module 11 may have a combination of a transformer, switch, rectifier, regulator, filter, controller and/or other components. For instance, a current mode controller model ICE2B265 along with associated circuitry may be implemented as part of the power supply module 11. Such device may be available from Infineon Technologies AG. An input of module 11 may 240/120 VAC. An output of module 11 may be about 12 VDC across line 19 and ground 21. The input and output may be another voltage according to the power supply design of module 11.

The sensor module 12 may have a sensing element 22 for detecting various levels of a gas such as $CO_2$. Element 22 may be a non-dispersive infrared (NDIR) sensing device. An output line 23 of sensing 22 may have an analog signal indicating a magnitude of a sensed gas, such as the $CO_2$. Line 23 may be connected to an interface circuit 24. Circuit 24 may convert the analog signal on line 24 to a digital signal which is sent to a digital processor 25 on line 26 for processing and evaluation. Signals resulting from the processing may be sent to circuit 24 on line 27. Circuit 24 may convert the signal from processor 25 to an analog signal. Processor 25 may have software to provide an appropriate signal or signals for alarms, indicators and/or the like. The analog signal in circuit 24 may be processed, amplified and/or converted, as needed, and sent via line 28 for actuating relays 31 and/or relays 32 and 33. The relays may instead be some other kind of actuated switch, such a solid state device. One may note that the voltage on line 19 may be provided to power sensing element 22, interface circuit 24 and processor 25. Module 13 may have additional alarms of the same or other kinds, having various durations, for exhibiting a particular pattern or patterns. Such alarms may be simultaneous and/or separate and exhibit patterns that do not necessarily exhibit a satisfactory indication about the system but indicate particular problems and/or have diagnostic meanings. Module 12 may be expanded to accommodate an expanded alarm module 13.

A power indicator light 39, such as a green LED, may indicate whether there is electrical power to at least the sensor module 12. An off state of indicator light 39 may indicate not only a lack of power to the sensor module 12 but also a lack of power available for the alarms 15 and 16. Also, it may very likely mean a lack of power to the power supply module 11. Under normal circumstances, an interruption of power for test purposes may be indicated by an off state of the indicator light 39. During a power-on sequence, whether due to initial or interrupted power, the light 39 should be in an on state. Light 39 may be utilized for other system 10 indications, such as a blinking light to indicate other potential problems with the system 10 such as poor sensing element calibration.

At a first level of $CO_2$ concentration in the ambient environment of the sensor system 10, the sensor module 12 with a signal from circuit 24 along line 28 may cause a first relay 31 to close or connect power from line 19 to line 29 resulting in a voltage across the input terminal and ground 21 of a strobe light 15 to cause it to flash. At a higher level of $CO_2$ concentration, the sensor module 12 with a signal from circuit 24 along a line 34 may cause a second relay 32 to close or connect power from line 19 to line 35 resulting in a voltage across the input terminal and ground 21 of horn 16 to cause it to sound while the strobe continues to flash. The first and second levels of $CO_2$ concentration may be, for instance, 15,000 ppm and 30,000 ppm, respectively. 15,000 may be regarded as a warning and 30,000 ppm as a significant threat relative to the health of persons in the vicinity of the sensor module 12. Other levels of alarm thresholds may be selected and defined. If the magnitude of the $CO_2$ or other gas decreases below the second and first levels, the second and first alarms may cease, respectively.

There may be one or more annunciators or other indicators noting that one or both levels of $CO_2$ concentration were previously achieved after the alarms are inactivated. An output line 38 from interface circuit 24 may provide a DC voltage between 0 and 5 volts proportionally or linearly representing a magnitude of $CO_2$ detected by sensing element 22. For instance, 0 volts may represent 0 ppm, 2.5 volts may represent 15,000 ppm and 5 volts may represent 30,000 ppm. The voltage representation of ppm values may be different than those indicated herein.

Connected in parallel with the second relay 32 may be a third relay 33 which is a dedicated two-wire dry contact device. Relay 33 need not be connected in the system 10. Relay 33 may be connected, for example, to an auxiliary device. Relay 33 may instead be a normally closed relay. It may be connected to a fire alarm panel of a facility, at the discretion of the installer or user, for instance, in indicating a 30,000 ppm concentration of $CO_2$. A signal on line 34 may close relay 33 to provide a voltage or power from line 19 on an output line 36 of relay 33.

A characteristic of the present alarm system 10 is that it may be hardwired (i.e., the power input is wired directly to 120/240 VAC or other available electrical power, but not plugged into an electrical outlet. The hard-wired system 10 may provide constant protection of sustained power to the alarm system, and prevent the risks of the easy pulling or disconnecting of a plug/outlet of power supply connection. A problem may include verifying that the sensor 10 is properly wired to the power and operating correctly once its hardwired connection is made.

The sensor alarm system 10 may provide a momentary power interrupt with a push-button normally-closed switch 37 in the power supply module 11. The interrupt may be effected in other ways such as a processor initiated interrupt. The interrupting mechanism may be solid state device other kind of device. When the power interrupt button switch 37 is pressed at the power supply module 11, the sensor module 12 may have the processor 25 with respective software to initiate a pre-determined sequence for relays 31 and 32. The sequence may be designed to start about 15 seconds after power turn-on or interrupt. When the sequence begins, for example, the first relay 31 and the second relay 32 may close simultaneously. The first relay may be closed for a duration of ten seconds and the second relay may be closed for a duration of two seconds. These durations are just examples, as the durations may be for other periods of time. Testing the sensor system 10 may then verify that the strobe 15 and horn 16 outputs correspond to the relay closings. In other words, the strobe 15 and the horn 16 may be energized simultaneously, with the horn 16 ceasing after the two seconds, and the strobe 15 ceasing after ten seconds. Other patterns of alarms may be programmed in module 12 for indicating a correct connection and normal operation of the system. Other types of alarms may be used.

A delay of, or a different sequence of, alarms 15 and 16, other than expected, or no sequence, may indicate incorrect wiring of the power to the system or between the modules 11, 12 and/or 13, a defective component such as the processor 25, a circuit 24 element, sensing element 22, relay 31 or 32, strobe 15 or horn 16, or poor or broken inter- or intra-module 11, 12 or 13 connections, due to incorrect installation, tampering or hardware or software failure. There may be other causes of an incorrect or no sequence other than noted herein. The built-in power interrupt and the power-on sequence at the sensor may be one characteristic of the sensor system 10. The power-on sequence may be of various forms or patterns as long as the form or pattern is defined, expected and known to the tester. The interrupt push button 37 may be replaced with a programmed interrupt and/or reset mechanism, for example, with software in processor 25, for system 10 testing.

The sensor module 12 may have an automatic background calibration relative to sensing element 22. If the background calibration drifts from the factory calibration by 3000 ppm, the strobe alarm 15 may intermittently flash or flash for about 10 seconds each minute. This may mean that the sensing element 22 should be replaced. Other components of system 10 may also be checked. The system 10 may be tested regularly by depressing the push button 37 to reasonably ensure that the system has not been tampered with and is operating normally.

Figure 3:
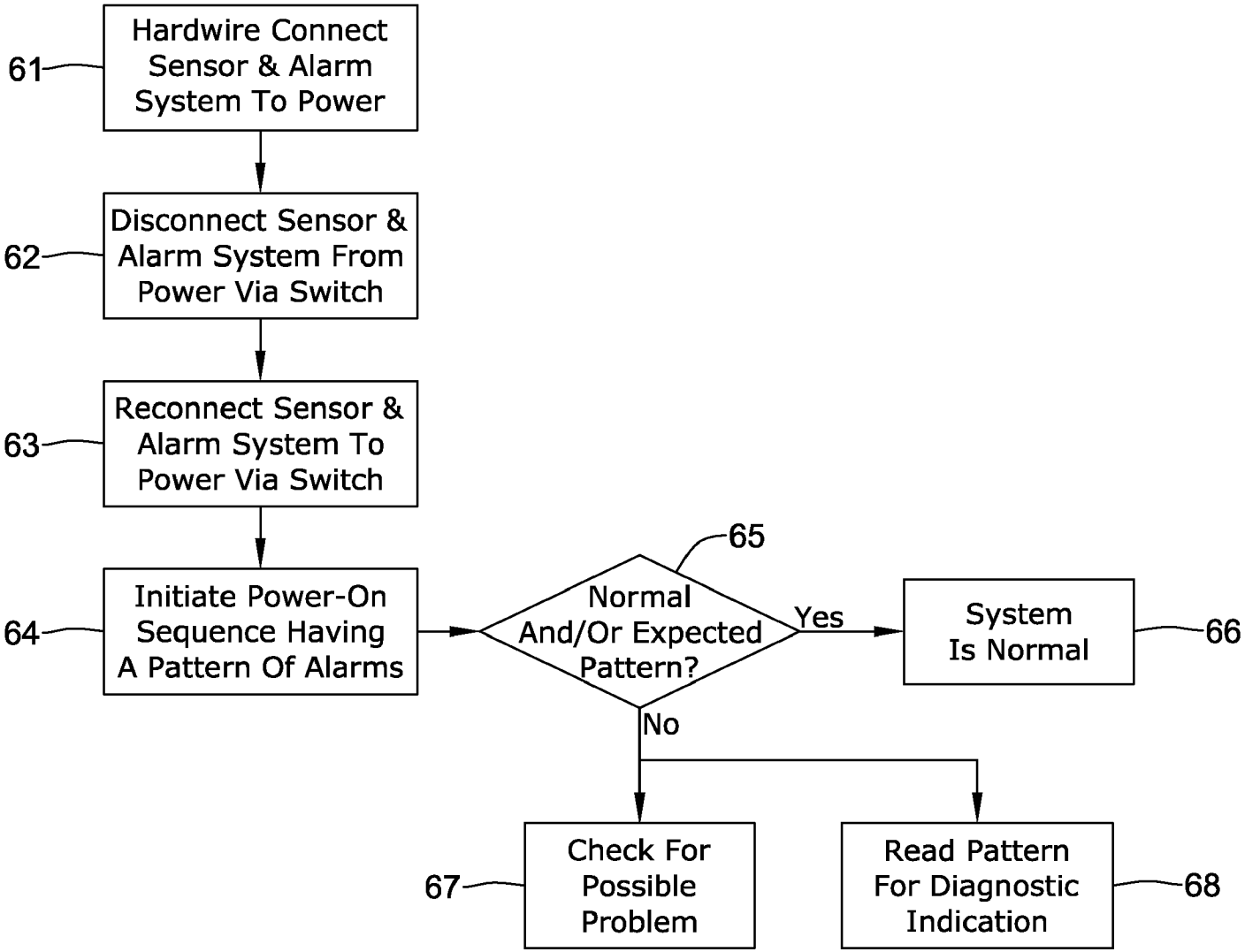
FIG. 3 is a diagram of a power-on sequence approach of the system.

FIG. 3 is a flow diagram of an illustrative example of a power-on sequence as a system check. The sensor and alarm system may be permanently connected or hardwired to power according to block 61. The system may be disconnected (for instance, temporarily with a push button) with a switch from power according to block 62. The system may be promptly reconnected with the switch to power as in block 63. Upon reconnection, a power-on sequence of alarms in a pattern may be initiated by the system, according to block 64. In diamond 65 is a question as to whether the alarms are exhibited in a normal and/or expected pattern. If the answer is "Yes", then the system is fine or normal as in block 66. If the answer is "No", then as in block 67 one may check for a problem in the system. However, the alarms may be simultaneous and/or separate and exhibit a pattern that does not exhibit a satisfactory condition about the system but indicates a particular problem and/or diagnostic meaning, as in block 68. The alarms may be a combination of numerous visual, audio and/or other kinds of alarms, having various durations.

Figure 4:
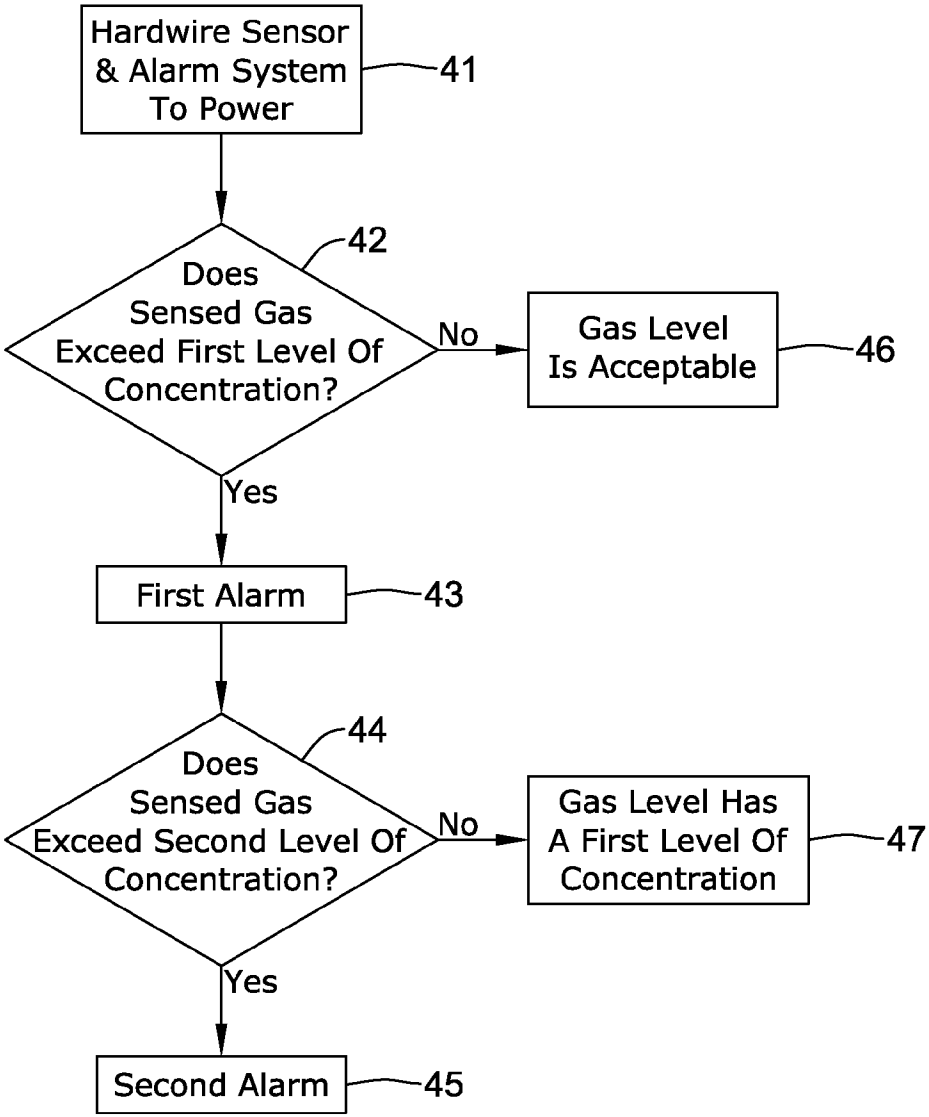
FIG. 4 shows a level of gas concentration approach of the system.

FIG. 4 is a flow diagram of an illustrative example of indicating gas concentrations by the present system. Block 41 shows a permanent or hardwire connecting of the sensor and alarm system to power. Diamond 42 is a question of whether the sensed gas exceeds a first level of concentration. If the answer is "Yes", then a first alarm may be energized according to block 43. If not, then the gas level may be fine or acceptable as in block 46. Diamond 44 asks the question of whether the sensed gas exceeds a second level of concentration. If the answer is "Yes", then a second alarm may be energized according to block 45. The alarms may be simultaneous and/or separate, and exhibit a pattern having a diagnostic meaning. If not, then the concentration may be still at the first level as indicated by block 47. The alarms or their pattern may be further or instead a combination of two or more visual, audio and/or other kinds of alarms, having various durations.

Figure 5:
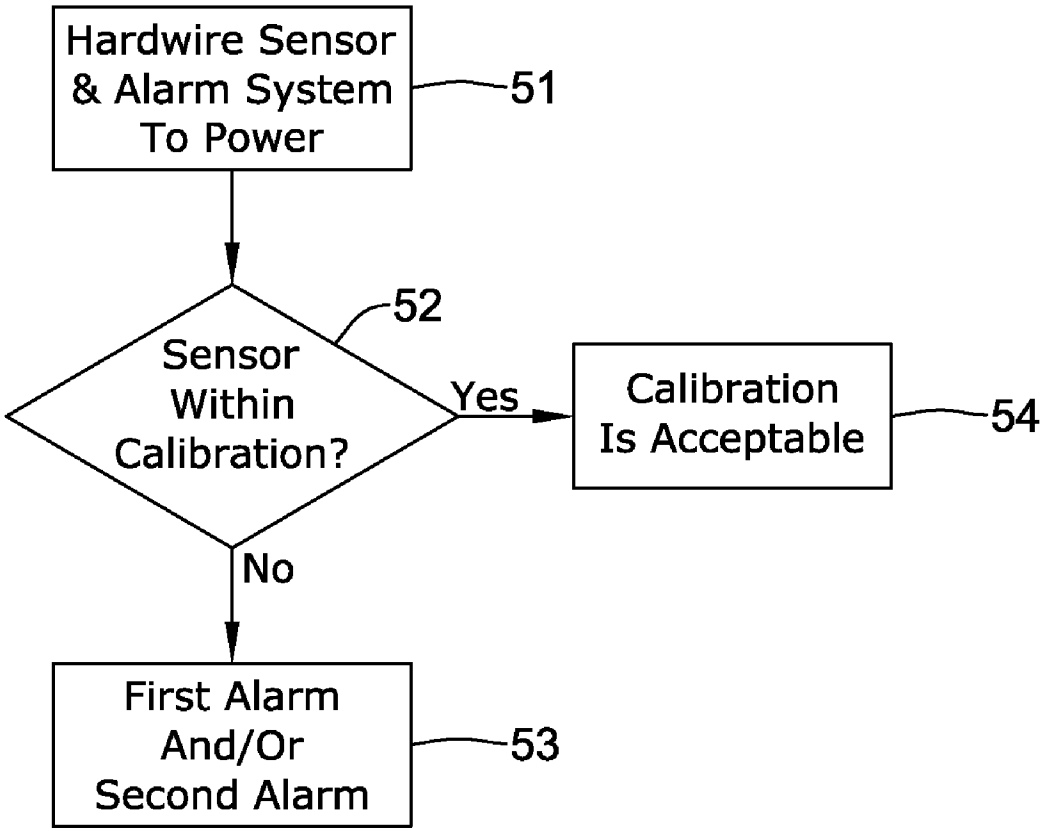
FIG. 5 reveals a sensing element calibration warning aspect of the system.

FIG. 5 is a flow diagram of an illustrative example of the system's calibration indication. The system may be permanently hardwired or connected to power according to block 51. Diamond 52 asks the question of whether the sensor or sensing element of the system is within calibration. If the answer is "Yes", then the sensor calibration may be fine or acceptable as in block 54. If the answer is "No", then a first and/or second alarm (e.g., visual and/or audio alarm) may be energized according to block 53. The alarms may exhibit a diagnostic indicating pattern. The alarm pattern may further or instead include a combination of two or more visual, audio and/or other kinds of alarms, having various durations.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A sensor and alarm system for a building comprising:

a power supply module having a permanent disconnectable connection to power of the building;

a power interrupt switch that momentarily interrupts the permanent connection to power of the building, and then provides a power-on sequence of indicators in a pre-determined pattern to exhibit a satisfactory condition or a diagnostic meaning;

a sensor module connected to the power supply module; and an alarm module connected to the sensor module; and wherein:

the sensor module comprises:

an interface circuit;

a processor connected to the interface circuit;

a sensing element connected to the interface circuit;

the alarm module comprises:

a visual indicator; and an audio indicator;

the sensing element senses a gas in the building; and the alarm module activates the visual and/or audio indicator of a gas sensed in the building and of a level of concentration of the gas;

wherein the processor has an output that initiates the power-on sequence of visual and audio indicators in the pre-determined pattern that tests the connection and operation of the system, wherein an expected pattern of visual and audio indicators indicates a correct connection and/or operation and an unexpected pattern indicates an incorrect connection and/or operation.

2. The system of claim 1, wherein the permanent connection of the power supply module is hardwired to prevent risks of disconnection of the power supply module.

3. The system of claim 1, wherein the gas can be hazardous to health of occupants of the building.

4. The system of claim 3, wherein:

the visual indicator emanates a light if the level of concentration of the gas exceeds a first magnitude; and the audio indicator emanates a sound when the level of concentration of the gas exceeds a second magnitude.

5. The system of claim 4, further comprising a second visual indicator that indicates a power-on sequence, power on, a power interruption, a lack of power, poor sensing element calibration, and a potential problem with the system.

6. The system of claim 3, wherein:

the visual indicator is a strobe-light-like mechanism; and the audio indicator is a horn-like mechanism.

7. The system of claim 3, further comprising an output line from the interface circuit that provides a voltage representing a magnitude of the gas sensed by the sensing element in the building.

8. The system of claim 1, wherein the gas is $CO_2$.

9. The system of claim 8, wherein the building is selected from a group consisting of a carbonated beverage dispensing area, a manufacturing plant, a chemical laboratory, and a supermarket.

10. The system of claim 1, wherein the alarm module indicates a gas sensed in the building and the level of concentration of the gas, the alarm module further comprises:

an annuciator;

a telephone call; and/or an alert communication.

11. The system of claim 1, wherein the building sensor and alarm system is tied in with a building automation system of the building.

12. The system of claim 1, wherein the sensing element is a non-dispersive infrared sensing device.

13. The system of claim 1, wherein the processor has software to provide an appropriate signal or signals for alarms and indicators.

14. The system of claim 13, wherein the indicators of the alarm module provide simultaneous and/or separate pre-determined patterns that indicate particular problems and/or have diagnostic meanings.

15. The system of claim 1, wherein a gas indication output of the sensing module is connected to a fire alarm panel of the building and/or a facility.

16. The system of claim 1, further comprising automatic background calibration relative to the sensing element for calibration the sensing element, indicating an amount of drift from a factory calibration, or indicating that the sensing element should be replaced.

17. The system of claim 1, wherein the power interrupt switch is a processor initiated interrupt.

18. The system of claim 1, wherein the visual indicator continues to emanate light when the concentration of gas exceeds the second magnitude and the audio indicator emanates sound.

19. A sensor and alarm system for a building comprising:

a power supply module having a permanent, hardwired, disconnectable connection to power of the building;

a power interrupt switch that momentarily interrupts the hardwired connection to power of the building for manually initiating a power-on sequence;

a sensor module connected to the power supply module, the sensor module including an interface circuit, a processor connected to the interface circuit, and a sensing element connected to the interface circuit, wherein the sensing element senses a gas in the building;

an alarm module connected to the sensor module, the alarm module including a visual indicator and an audio indicator, wherein the alarm module activates the visual and/or audio indicator if a gas is sensed in the building; and wherein the processor has an output that, after interruption of power, initiates the power-on sequence of one or more of the visual and audio indicators in an expected pattern that tests the connection and operation of the system, wherein occurrence of the indicators in the expected pattern indicates a correct connection and/or operation of the system, and occurrence of the indicators in an unexpected pattern indicates an incorrect connection and/or operation of the system.

20. The system of claim 19, wherein the processor is configured to interrupt power at programmable intervals.

21. The system of claim 19, wherein the power-on sequence includes both visual and audio indicators.

22. The system of claim 21, wherein the processor has outputs of two or more different expected patterns of indicators, wherein each expected pattern corresponds with a different diagnostic meaning.

* * * * *